US007595753B2

(12) United States Patent
Ratni

(10) Patent No.: US 7,595,753 B2
(45) Date of Patent: Sep. 29, 2009

(54) BROADBAND BEAM STEERING ANTENNA

(75) Inventor: Mohamed Ratni, Esslingen (DE)

(73) Assignee: Sony Deutschland GmbH, Berlin (DE)

( * ) Notice: Subject to any disclaimer, the term of this patent is extended or adjusted under 35 U.S.C. 154(b) by 0 days.

(21) Appl. No.: 12/039,238

(22) Filed: Feb. 28, 2008

(65) Prior Publication Data

US 2008/0238774 A1 Oct. 2, 2008

(30) Foreign Application Priority Data

Mar. 30, 2007 (EP) ..... 07006737
Jun. 13, 2007 (EP) ..... 07110213

(51) Int. Cl.
*H01Q 3/00* (2006.01)
*H01Q 3/22* (2006.01)

(52) U.S. Cl. ..... 342/375; 342/372

(58) Field of Classification Search ..... 342/368, 342/372, 374, 375

See application file for complete search history.

(56) References Cited

U.S. PATENT DOCUMENTS 3,858,221 A 12/1974 Harrison et al.
3,887,925 A 6/1975 Ranghelli et al.
4,213,133 A 7/1980 Hidaka
4,719,470 A 1/1988 Munson

OTHER PUBLICATIONS

B. M. Schiffman, "A New Class of Broad-Band Microwave 90-Degree Phase Shifters", IRE Transactions on Microwave Theory and Techniques, vol. MTT-6, No. 2, XP009087234, Apr. 1958, pp. 232-237.

*Primary Examiner*—Dao L Phan
(74) *Attorney, Agent, or Firm*—Oblon, Spivak, McClelland, Maier & Neustadt, L.L.P.

(57) ABSTRACT

An antenna apparatus attachable to the front-end of a transceiver circuitry, includes at least two balanced radiation elements forming a planar structure for transmitting and/or receiving a corresponding number of partial signals. The antenna apparatus also includes a signal splitter and/or combiner for splitting a signal received from an attached transceiver circuitry into said partial signals and/or combining said partial signals into a signal to be transmitted to an attached transceiver circuitry, a phase shifter device that applies relative phase shifts between at least two of said partial signals. The relative phase shifts are selectable from a group of at least two relative phase shift values provided by the phase shifter device.

22 Claims, 6 Drawing Sheets

BROADBAND BEAM STEERING ANTENNA

FIELD OF THE INVENTION

The present invention relates to an antenna apparatus with steerable beam pattern, an RF transceiver comprising the antenna apparatus and a mobile device comprising the antenna apparatus.

DESCRIPTION OF THE RELATED PRIOR ART

The American Federal Communications Commission (FCC) allows unlicensed use of the 3.1 GHz to 10.6 GHz frequency band for ultra-wideband (UWB) applications, whereby UWB refers to a broadband radio technology having a bandwidth larger than 500 MHz or larger than 25% of the center frequency. An ultra-wideband frequency range, for example, is a frequency range having a bandwidth larger than 500 MHz or larger than 25% of the center frequency. Other nations and organizations have followed and or are expected to follow the FCC regulations. The IEEE 802.15 working group develops standards for wireless short distance or wireless personal area networks. The group's WPAN™ technology employs the 3.1 GHz to 10.6 GHz range and addresses wireless networking of portable and mobile computing devices such as PCs, PDAs, peripherals, cell phones, pagers and consumer electronics, allowing those devices to communicate and interoperate with each other and employing the 3.1 GHz to 10.6 GHz range.

UWB technology was at first developed in connection with radar applications. Today, however, UWB systems are also used as a wireless RF interface (e.g. wireless USB) between mobile terminals (e.g. cell phones, laptops, PDAs, wireless cameras, MP3 players) with much higher data rates than Bluetooth or IEEE 802.11. A UWB system can further be used as an integrated system for automotive in-car services, for example, as an entertainment system or any location-based system (e.g. for downloading audio or video data for passenger entertainment).

Traditionally, mobile and wireless handsets are equipped with a single narrowband 3D monopole or planar antenna. Planar ultra-wideband antennas including dipole, patch and bow-tie antennas and other types of planar structures are employed in a wide variety of applications today. Phased arrays that are operated with variable phase shifters are known to provide beam steering property. However, phased array antennas are relatively large in size and their integration in mobile devices (e.g. consumer electronic devices) is very challenging.

In view of the explanations provided above, it is the object of the present invention to provide a mobile device with a beam steerable antenna and a beam steerable antenna and RF transceiver suitable for employment in a mobile device.

SUMMARY OF THE INVENTION

The antenna apparatus according to the present invention is attachable to the front-end of a transceiver circuitry and comprises at least two balanced radiation elements forming a planar structure, for transmitting and/or receiving a corresponding number of partial signals, a signal splitter and/or combiner for splitting a signal received from an attached transceiver circuitry into said partial signals and/or combining said partial signals into a signal to be transmitted to an attached transceiver circuitry, a phase shifter device operable to apply relative phase shifts between at least two of said partial signals, whereby said relative phase shifts are selectable from a group of at least two relative phase shift values provided by said phase shifter device.

By providing a plurality of balanced radiation elements, a high antenna gain is provided. By providing a phase shifter device operable to apply the relative phase shifts, a plurality of radiation patterns (radiation beams) with different orientations are obtained, thus a beam steering antenna is provided. A high gain beam steering antenna reduces the power and energy needed, to operate an RF transmitter and/or receiver, thus, battery size of a mobile device can be reduced. Such antenna typically achieves a better reception in dead spots and is useful employed, for example, near walls (e.g. in a closed room) to achieve better signal reception and emission. By providing radiation elements in a planar structure, the antenna apparatus is small and is suitable for integration into mobile devices.

The RF transceiver according to the present invention comprises a transceiver front-end circuitry and an antenna apparatus according to the present invention wherein the transceiver front-end circuitry and the antenna apparatus are provided on a single printed circuit board. The inventive RF transceiver has, in addition to the advantages of the inventive antenna apparatus, the benefits of low cost of production, small size and high mechanical resistance (e.g. to shocks).

The mobile device according to the present invention comprises the antenna apparatus according to the present invention or the RF transceiver according to the present invention.

Advantageously comprises said signal splitter and/or combiner a Wilkinson power splitter.

Advantageously is said phase shifter device a broadband phase shifting device, operable in an ultra-wideband frequency range.

Advantageously comprises said phase shifter device a Schiffmann phase shifter.

Advantageously is the number of balanced radiation elements four.

Advantageously are the balanced radiation elements arranged in a rectangular grid.

Advantageously is said phase shifter device operable to apply six different nonzero phase shift values between any two of said partial signals, whereby for every one of the six different phase shift values there is another one of the six different phase shift values having the same absolute value but the opposite sign.

Advantageously comprises the phase shifter device a number of phase shifter banks according to the number of radiation elements, each phase shifter bank thereby comprising a plurality of selectable delay lines and operable to shift a corresponding one of said partial signals in phase by means of a selected one of said plurality of selectable delay lines.

Advantageously are the phase shifter banks identical.

Advantageously comprises each of said phase shifter banks exactly five selectable delay lines.

Advantageously comprises at least one of the radiation elements at least one balance element having a signal feeding point of which the width varies with the distance from the signal feeding point.

Advantageously are the balanced radiation elements identical.

Advantageously is the signal path of two partial signals between which no relative phase shift is applied mirror symmetric or point symmetric.

Advantageously are the balanced radiation elements adapted to emit and/or receive a radiation beam which has a vertical polarization.

Advantageously has a radiation beam emitted from and/or received by the balanced radiation elements a variation of the amplitude response of equal or less than 2 dBi over an ultra-wideband frequency range.

Advantageously has a radiation beam emitted from and/or received by the balanced radiation elements a phase variation which is linear in frequency over an ultra-wideband frequency range.

Advantageously provides the antenna apparatus a return of loss which is less than −10 dB in an ultra-wideband frequency range.

Advantageously comprises the antenna apparatus a planar reflector element parallel to the balanced radiation elements.

Advantageously is the reflector element located between the radiation elements and the phase shifter device and/or is the reflector element located between the balanced radiation elements and the signal splitter and/or combiner.

In the inventive RF transceiver, the antenna apparatus and the transceiver front-end circuitry advantageously share the core substrate of conducting material of the printed circuit board.

BRIEF DESCRIPTION OF THE DRAWINGS

The present invention is explained with reference to figures of which

DESCRIPTION OF THE DETAILED EMBODIMENTS

Figure 1:
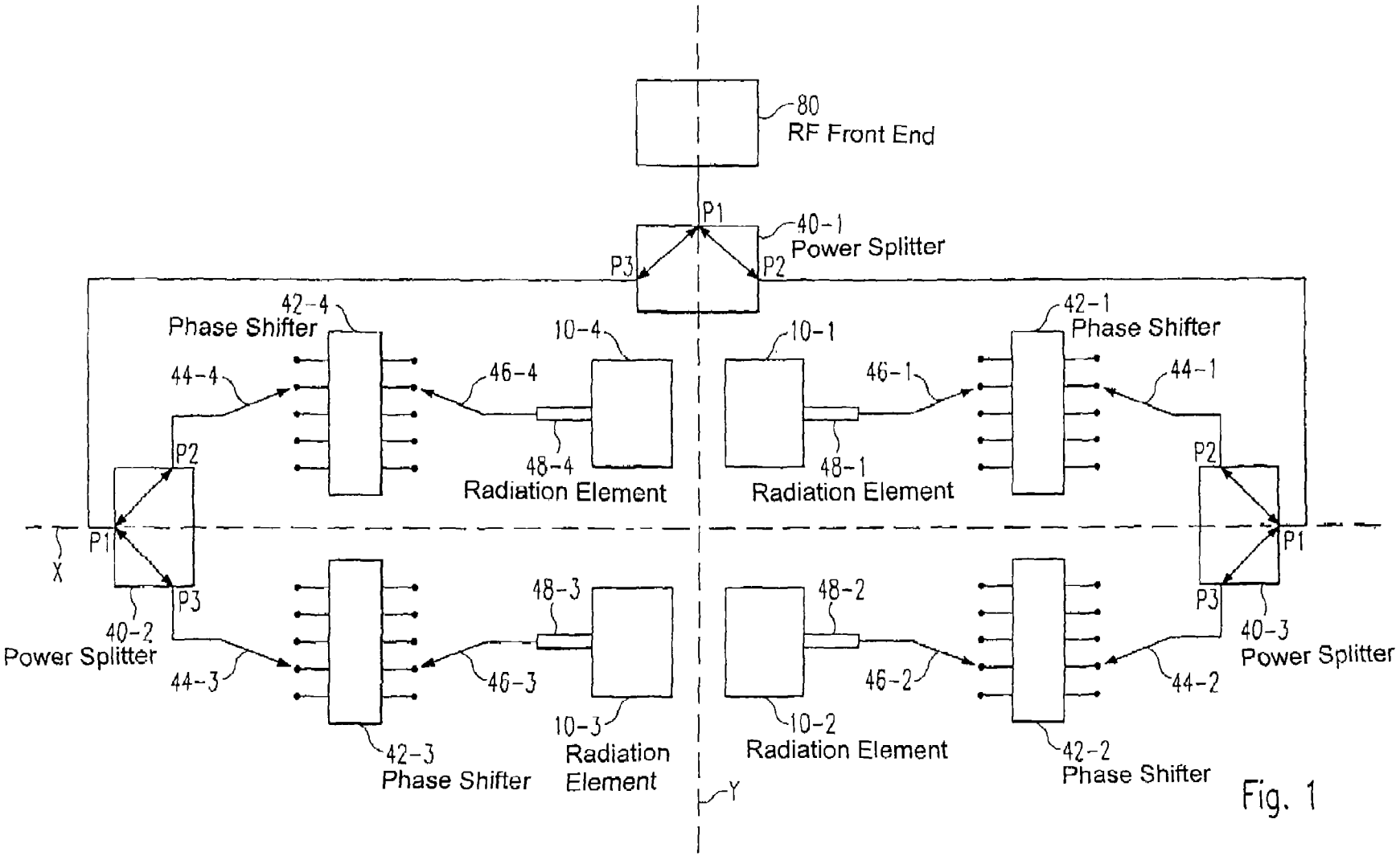
FIG. 1 shows a first embodiment of an antenna apparatus according to the present invention and an RF transceiver according to the present invention.
Figure 2:
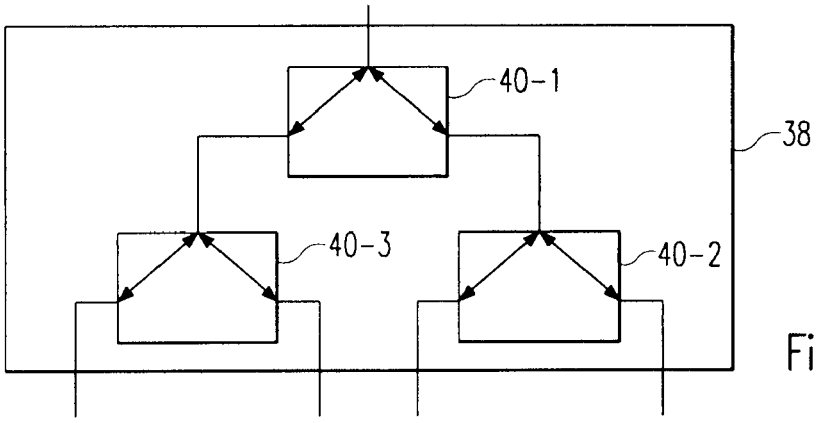
FIG. 2 shows a power splitter employed in the first embodiment.

FIG. 1 shows a block diagram of a first embodiment of an antenna apparatus 1 according to the present invention. The embodiment provides an ultra-wideband, high gain, directional beam steering antenna in the microwave spectrum. In this embodiment four radiation elements 10-1, 10-2, 10-3, 10-4 forming an array 24 of antennas are provided, however, two or more radiation elements are sufficient to implement the present invention. The antenna apparatus 1 receives and transmits an RF signal from and to the front-end of a transceiver circuitry 80. The embodiment described is designed for a center frequency $f_0$ of the RF signal of 4 GHz and a bandwidth of 2 GHz. The present invention can, however, be profitably employed for frequency ranges other than 3 to 5 GHz and, especially, is not limited to the above mentioned regulatory frequency range of 3.1 to 10.6 GHz. In order to operate in a higher frequency band the antenna apparatus 1 has to be downsized and in order to operate in a lower frequency band the antenna apparatus 1 has to be upsized, as is known to the person skilled in the art (wavelength inversely proportional to frequency). The received signal is split (divided) in a power splitter 38 (not shown explicitly in FIG. 1, since composed of power splitters 40-1, 40-2, 40-3, see FIG. 2) into equal power and equal phase split signals. The present invention may, however, also be implemented with non-equal-power and non-equal-phase power splitters 38. Each of the split signals is applied to a separate output port of the power splitter 38, each output port connected to a separate "branch" of electronic circuitry comprising exactly one radiation element 10 of the array 24. If a power splitter 38 does not provide equal phase split signals this can be compensated, for example, by properly designed phase shifter banks or by properly designed transmission lines. It is to be noted however, that equal phase is not necessary to implement the present invention. In case of the present embodiment, the received signal is split into four signals according to the four radiation elements 10 provided by the antenna apparatus 1. In case of the present embodiment, the power splitter 38 is realized by three cascaded power splitters 40-1, 40-2, 40-3. Each one of the power splitters 40 has three ports: one input port (P1) and two output ports (P2, P3). Besides splitting a signal that is received at the input port equally to the output ports, each one of the power splitters 40 combines (adds) signals received at the two output ports and applies the combined signal to the input port. The two output ports of the first stage power splitter 40-1 are connected to the two input ports of the second stage power splitters 40-2, 40-3. In case of the present embodiment, the power splitters 40 are Wilkinson power splitters. Wilkinson power splitters offer the advantage of the output ports being simultaneously isolated and matched (at a given design frequency, e.g. $f_0$=4 GHz). The cascaded Wilkinson power splitter offers a 6 dB loss at the end of each branch. Instead of three cascaded 3-port (2-branch) Wilkinson power splitters, a single 5-port (4-branch) Wilkinson power splitter can be employed. The power splitter 38 is formed by conductive traces (striplines/microstrips) of well-defined form and material on or in a PCB. The operational bandwidth may be increased by optimizing the conductive traces.

In this embodiment all branches are the same and it is understood, that if a description relating to only one branch or any element of only one branch is given, the description applies to all other branches as well.

The direction of maximum emission and reception of RF radiation (i.e. the direction of the radiation beam) of the antenna apparatus 1 is controlled by applying phase shifts to the signals in each branch. To this end, the embodiment provides four phase shifter banks 42-1, 42-2, 42-3, 42-4 according to the number of radiation elements 10 in the array 24. In the embodiment, the phase shifter banks 42 are the same in terms of functionality provided and have essentially the same construction. The present invention may, however, also be implemented with phase shifter banks 42 which have different constructions and provide different functionality/phase shifts. In the embodiment, each phase shifter bank 42 comprises five delay lines 36-1, 36-2, 36-3, 36-4, 36-5 (not shown in FIG. 1), which correspond to five different phase shift characteristics (phase shift dependent on frequency) which are alternatively applicable to a branch signal. If a different delay line 36 is selected in any two branches, then the signals in the respective two branches will exhibit a relative phase shift given by the difference of phase shift characteristics of the selected delay lines 36. By this means 90°, 135° and 225° relative phase shifts are realized. 0° relative phase shifts are realized by selecting the same delay line 36 in any two branches. In each branch, power splitter side switches 44-1, 44-2, 44-3, 44-4 and antenna side switches 46-1, 46-2, 46-3, 46-4 insert one delay line 36 at a time into the signal path from the radiation element 10 to the power splitter 40. If a delay line 36 is not inserted into the signal path, it is disconnected from the signal path at the antenna side and at the power splitter side by the antenna side switches 46 and the power splitter side switches 44, respectively. The switches 44, 46 are RF switches specifically adapted to switch and transmit the RF signals of the frequency range in question. The switches 44, 46 are electrically controlled by an antenna controlling unit (not shown), thereby the beam steering is automated. The antenna controlling unit may be programmed to control the switches so as to scan all possible directions and lock to the direction with the best received signal strength. The phase shifter banks 42 (i.e. the delay lines 36) are formed by conductive traces (striplines/microstrips) of well-defined form and material on or in a PCB. In the embodiment, each phase shifter bank 42 provides five different phase shift characteristics. The present invention may, however, also be implemented with two or more different phase shift characteristics. Also, some branches may be provided with a phase shifter bank while others may not.

The signal received from and transmitted to the transceiver circuitry is an unbalanced signal, the radiation elements 10 are of the dipole type and operate with a balanced signal, therefore a conversion is performed. The branch signals are feed to and collected from the radiation elements 10 by means of unbalanced-balanced microstrips 48-1, 48-2, 48-3, 48-4. These microstrips 48 provide a conversion from an unbalanced signal to a balanced signal and vice versa. Other balun-type devices may be employed however.

In the embodiment, a reflector element 26 (not shown in FIG. 1) provided in proximity of the antenna array 24. The reflector element 26 partly shields the radiation elements 10 and modifies the directional characteristic and frequency response of the antenna array 24. The reflector element 26 may be at floating potential or may be connected to ground potential.

The embodiment provides a symmetric arrangement. FIG. 1 shows an X- and a Y-axis of an orthogonal coordinate system further comprising a Z-axis (orthogonal to the drawing plane) corresponding to—as a manner of speaking—a "height". The power splitters 40, the switches 44, the switches 46, the balanced to unbalanced microstrips 48, the radiation elements 10, the reflector element 26 and the transmission lines (including the elements in these components, e.g. the delay lines 36) each are arranged mirror symmetric with respect to a Y-plane (Y=0) comprising the X-axis and the Z-axis and/or are arranged mirror symmetric with respect to an X-plane (X=0) comprising the Y-axis and the Z-axis and/or are arranged point symmetric within the Z-plane (Z=0) with respect to the origin (X=0, Y=0). Which components obey which symmetry can be derived from FIG. 1 and FIG. 4. For example, the corresponding components in the first branch and the fourth branch (e.g. the phase shifter banks 42-1 and 42-4) are arranged mirror symmetric with respect to the X-plane. As another example, the corresponding components in the first branch and in the second branch (e.g. the switches 44-1 and 44-2) are arranged mirror symmetric with respect to the Y-plane. As still another example, the corresponding components of the first branch and the third branch (e.g. the transmission lines between the components) are arranged point symmetric. As a last example, the power splitters 40-2 and 40-3 are arranged mirror symmetric with respect to the X-plane and point symmetric. Thus, the signal path of two branch signals to which no relative phase shift is applied is symmetric (mirror and/or point) in space. Therefore, the time needed for design and testing of the antenna apparatus 1 decreases und, thus, the price of the antenna apparatus 1 is reduced. Because of the symmetry of the radiation elements 10, the main beam pattern (see below) exhibits symmetry and the set of possible beam pattern directions exhibit symmetry.

In the embodiment, the power splitter 38, the phase shifter banks 42, the antenna feeds 48, the radiation elements 10, the reflector element 26 and the transmission lines connecting these elements are formed by conductive traces (striplines/microstrips) of well-defined form and material on or in a single PCB. Therefore, the present invention can be cheaply manufactured, is highly integrated and small (especially flat) and highly resistant to shocks and other mechanical wear. By using a common layout procedure and a common substrate, the antenna print and the classical RF front-end circuitry 80 can be simultaneously manufactured, so that a substantial cost reduction is achieved.

Alternatively, a separate antenna module comprising the radiation elements 10 and the microstrips 48 and, eventually, the reflector element 26 may be provided. In this case, the microstrips 48 may be connected to the feeding network (i.e. the switches 44, 46, the phase shifter banks 42, the power splitter 38 and the interconnections) by a coaxial cable or a mini-SMP connector.

Figure 3:
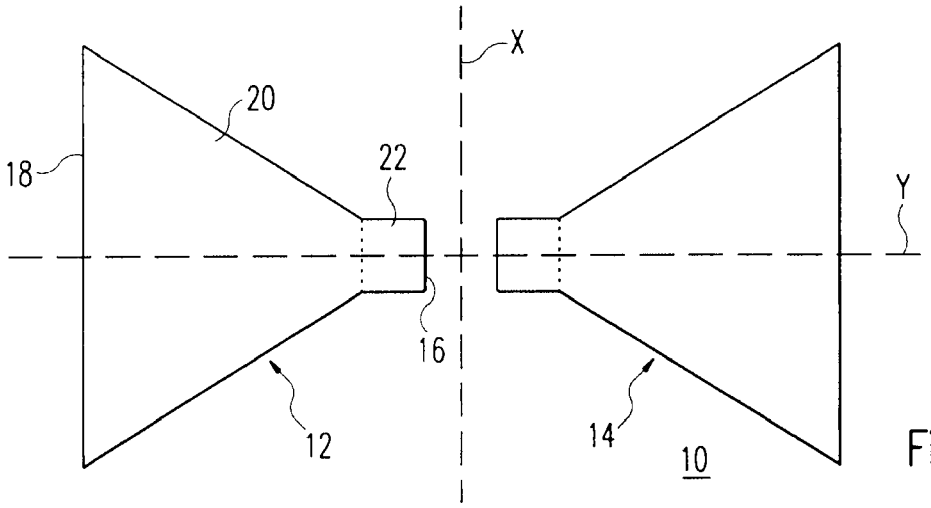
FIG. 3 shows a balanced radiation element employed in the first embodiment.

FIG. 3 shows a balanced radiation element (dipole type antenna) 10 consisting of two conducting balance elements 12, 14. The balanced radiation element 10 is described with the help of an Y'-Y'-Z' orthogonal coordinate system which differs from the X-Y-Z coordinate system only by a translation. The balanced radiation element 10 is essentially flat and is confined within a small region around the Z-plane (Z=0). The balanced radiation element 10 is mirror symmetric with respect to the Y'-axis which extends along the length of the balanced radiation element 10. Thereby, each of the balance elements 12, 14 is mirror symmetric with respect to the Y'-axis. The balanced radiation element 10 is mirror symmetric with respect to the X'-axis which extends along the width of the balanced radiation element 10. Thereby, one of the balance elements 12, 14 is a mirror image of the other one of the balance elements 12, 14. Both balance elements 12, 14 may, for example, be formed on one side of a (planar) printed circuit board (PCB). Alternatively, balance element 12 may be formed on the bottom surface of a PCB and balance element 14 may be formed on the top surface of a PCB or vice versa. In the latter case, the thickness of the PCB should be small compared to a characteristic dimension of the radiation element 10 as will be readily acknowledged by the skilled person. In the latter case still, the radiation element 10 point symmetrical with respect to the origin of the X'-Y'-Z' coordinate system, so that the balance element 14 is the point symmetrical image of the balance element 12. In both cases, the balance element 12 and the balance element 14 have the same shape and each of the balance elements 12, 14 is mirror symmetric with respect to an axis along the length of the balanced radiation element.

The balance elements 12, 14 have essentially the same shape and are made from the same material(s), for example, copper, aluminium and/or other metallic components. Thus, in the following, the balance element 12 is described and the description of balance element 14 is omitted and it is understood that the description of balance element 12 applies to balance element 14 where applicable. The balance element 12 is essentially flat. The balance element 12 has an inner or center end 16. The balance element 12 is feed at or near the center end 16 with an electric signal by a microstrip feed line (not shown) which is connected to the balance element 12 at or near to the center end 16. The inner end 16 of the balance element 12 is opposing the corresponding inner end of the balance element 14. The balance element 12 has an outer end 18, which is opposing the inner end 16. The balance element is tapering from the outer end 18 to the inner end 16 in order to achieve broadband impedance matching and provide a large bandwidth antenna. Thus, the width of the balance element 12 is higher at the outer end 18 than at the inner end 16. In the embodiment described, the balance element 12 has the specific shape of a triangle 20 of which one corner (the inner end corner) is cut away and replaced by a rectangle 22. The rectangle portion 22 is flush with the (cut) triangle portion 20. Thus, the shape of balanced radiation element 10 of the embodiment is resembling a bow tie. However, the present invention is not limited to bow type antennas. Another example, is a balanced antenna radiator formed by two rhombi, arranged such that the corresponding diagonals of the rhombi are aligned along the length, whereby the rhombi are feed at the inner, opposing corners. However, bow type antenna has the advantage of being shorter in length and, thus, providing a smaller size of the antenna apparatus.

Figure 4:
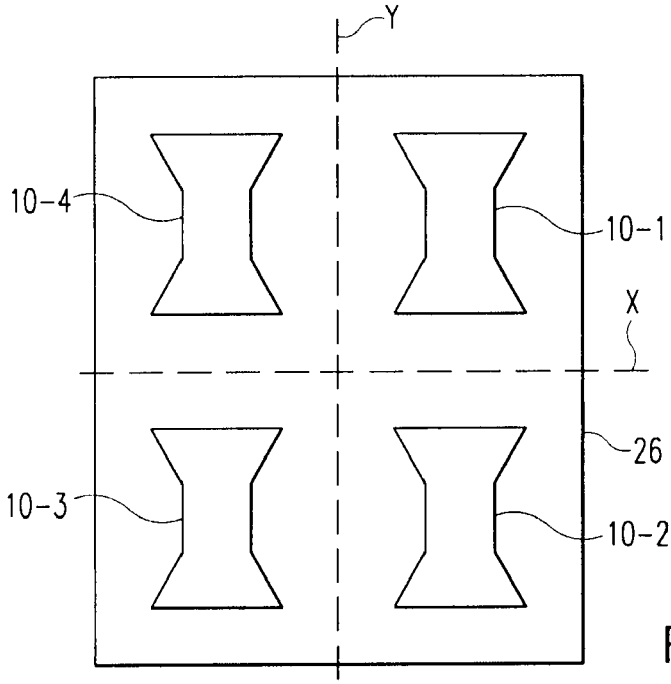
FIG. 4 shows an antenna array with a reflector element employed in the first embodiment.

FIG. 4 shows an array 24 of antennas and a reflector element 26. The array 24 comprises four balanced radiation elements 10-1, 10-2, 10-3, 10-4. The four balanced radiation elements are identical among themselves and are identical to the balanced radiation element 10 described above. Therefore, if not a specific one of the balanced radiation elements is desired to be addressed, it is simply referred to balanced radiation element 10 and the set of the balanced radiation elements is simply referred to as balanced radiation elements 10 (the same convention is adopted for the power splitters 40, the phase shifter banks 42, the power splitter side switches 44, the antenna side switches 46 and the balanced to unbalanced microstrips 48). The orientation of each of the balanced radiation elements 10 is the same as in FIG. 3. That is, the length of each of the balanced radiation elements 10 is along the Y-axis and the width of each of the balanced radiation elements 10 is along the X-axis. Also, the balanced radiation elements 10 are located at the same height at Z=0. Thus, the antenna array 24 is a planar device like the balanced radiation elements 10 and can be easily fabricated on a PCB, for example, by etching copper on a dielectrical substrate.

The balanced radiation elements 10 are arranged in a rectangular grid. The grid length in X-direction is greater than the width of the balanced radiation element 10 and the grid length in Y-direction is greater than the length of the balanced radiation element 10. The distance between the radiation elements 10 is optimized to achieve high gain and impedance matching in the whole frequency band. A grid length of $(0.63+/-0.3)*\lambda_0$ in X-direction and $(0.70+/-0.3)*\lambda_0$ in Y-direction has been shown to be advantageous, whereby $\lambda_0$ is the wavelength at the center frequency $f_0$ (e.g. 4.7 cm and 5.2 cm at $f_0$=4 GHz).

Located below and spaced from the balanced radiation elements 10 by a distance h>0 is the reflector element 26. The reflector element 26 may be made from any conducting material, including, for example, copper, aluminium and/or other metallic components. Preferably, the reflector element 26 is essentially flat and parallel to the X-Y-plane, that is, the reflector element 26 is preferably parallel to the plane in which the antenna array 24 lies. Preferably, the reflector element 26 extends at least just beyond the balanced radiation elements 10, has no holes and/or is of a convex shape. The planar reflector element 26 acts as a mirror to RF waves and reflects the radiation pattern in one plane, thus, assists in providing a high antenna gain. A high value of the reflector element's 26 surface impedance to electromagnetic waves is advantageous. The reflector plane 26 may extend considerably beyond the balanced radiation elements 10.

The reflector element 26 may for example have a rectangular shape as depicted in FIG. 4. The reflector element 26 may, for example by formed by etching copper on a dielectric substrate. The distance h is optimized in order to meet the specifications.

This type of antenna is able to achieve a bandwidth of more than 50% of the center frequency $f_0$ at a voltage standing wave ratio (VSWR) of 2:1. For a higher bandwidth, the impedance matching can be improved by modifying the shape of the radiation elements 10, for example, by smoothing the angles of the radiation elements 10.

The balanced radiation element 10 is feed by a balanced to unbalanced microstrip 30. The balanced to unbalanced microstrip 30 comprises a first conductor connected to the first balance element 12 and a second conductor connected to the second balance (element 14. The first and second conductors run parallel and close to each other. At one end, the first and second conductors are connected to or near to the inner ends 16 of the balance elements 12, 14. The first and second conductors are orthogonal to the length of the balanced radiation element 10. In case that the balance elements 12, 14 are located the top and the bottom side of a PCB, the first and the second conductors may too be located on the top and on the bottom side of the PCB, respectively. The construction and the application of a balanced to unbalanced microstrip 30 are known to the skilled person. A further description thereof is therefore omitted.

Figure 5:
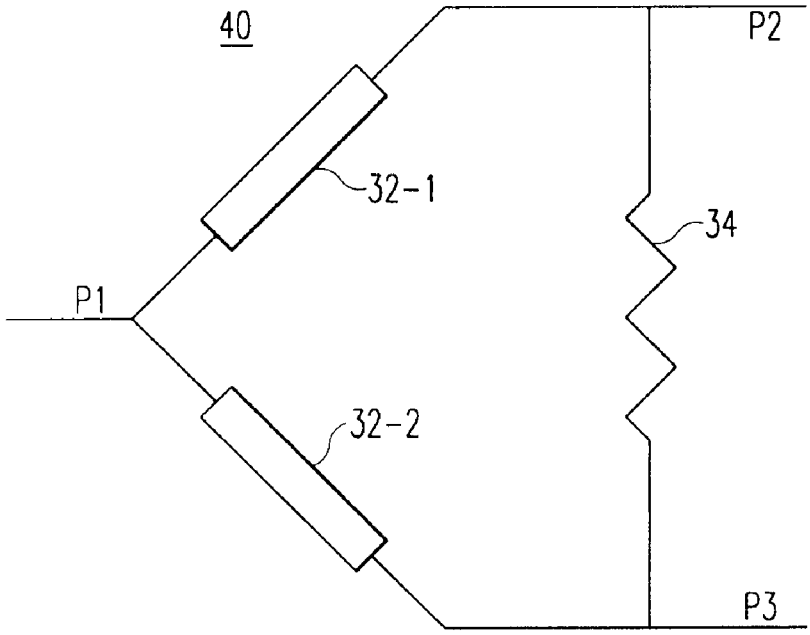
FIG. 5 shows a schematic of a Wilkinson power splitter employed in the first embodiment.

FIG. 5 shows a schematic diagram of one of the cascaded Wilkinson power splitters 40, which applies to each of the three cascaded Wilkinson power splitters 40. In the Wilkinson power splitter 40, the input port (P1) and the first output port (P2) are connected by a first microstrip line 32-1, the input port and the second output port (P3) are connected with a second microstrip line 32-2 and the first output port and the second output port are connected by a resistor 34 also formed by a microstrip line. The first and the second microstrip lines 32 are quarter wave transformers (i.e. apply a 90° phase shift) with a characteristic impedance of $\sqrt{2}*Z_0$ and the resistance of the resistor 34 is $2*Z_0$, whereby $Z_0$ is the characteristic impedance of the power splitter 40. Impedance matching is achieved, when all ports of the power splitter are terminated with a characteristic impedance of $Z_0$. It is to be noted, that the advantageous properties of the Wilkinson Power splitter of the output ports being isolated and matched are strictly valid only at a given design frequency (e.g. $f_0$=4 GHz) (the more the frequency is distinct from the design frequency, the more the properties are violated). Refinements of the basic design of FIG. 3 are known which provide for a more broadband Wilkinson power splitter than the principle design of FIG. 3. However, the basic design has been shown to be perform sufficiently well to obtain an ultra-wideband antenna apparatus (1).

Figure 6:
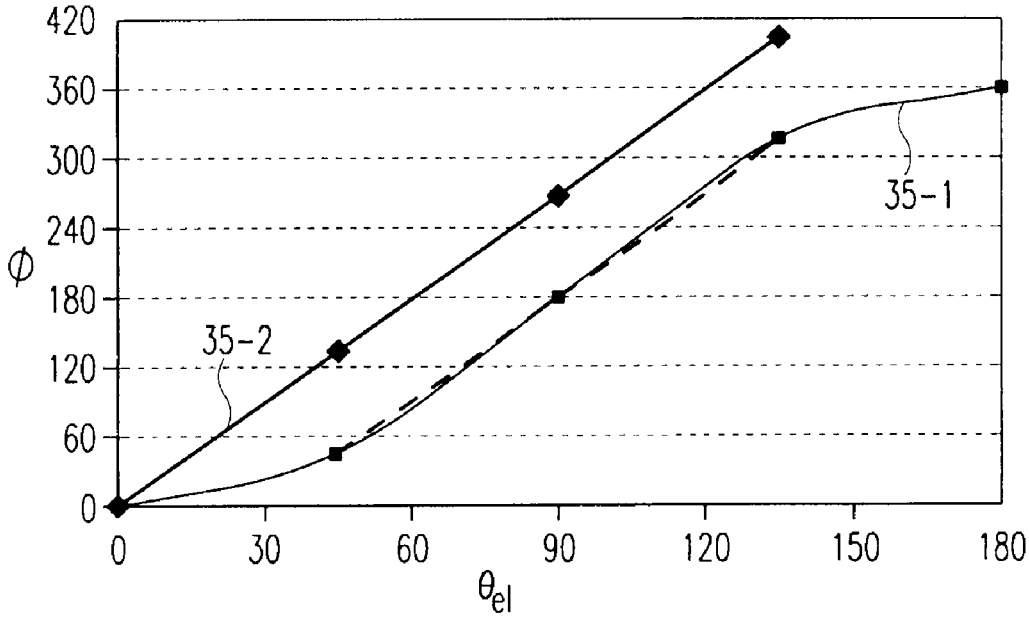
FIG. 6 shows a diagram of the phase shifts produced by coupled microstrip line and a uniform microstrip line versus the electrical length.

The generation of the relative phase shifts of 90°, 135° and 225° is explained with reference to FIGS. 6 and 7.

The type of phase shifter used are called Schiffman phase shifters (IRE Trans. MTT April 1958). These phase shifters employ a section of coupled microstrip transmission lines as key elements. The coupled lines of a Schiffman phase shifter are parallel, have equal length l and are connected at one end. The other end is used as input and output of the network (coupled lines seen as network). Since connected at one end, the two coupled lines may simply be called a coupled line. The image impedance $Z_1$ and the phase shift $\phi$ of such a coupled line is given by $$Z_l = \sqrt{Z_{0o}Z_{0e}}$$

and $$\cos\phi = \frac{\frac{Z_{0e}}{Z_{0o}} - \tan^2\theta_{el}}{\frac{Z_{0e}}{Z_{0o}} + \tan^2\theta_{el}},$$

whereby $Z_{0o}$ and $Z_{0e}$ are the odd and even characteristic impedances of the coupled line, $\theta_{el}=\beta*l$ is the electrical length of each of the coupled lines and β is the phase constant. This differs from a uniform microstrip line, which produces a phase shift that is proportional to the electrical length. FIG. 6 shows a plot of the phase shifts 35 produced by a coupled line and of a uniform line versus the electrical length $\theta_{el}$. It can be seen that there is a large range (approx. 45° to 135°) in the electrical length where the phase characteristic 35-1 of the coupled line is approximately parallel to the phase characteristic 35-2 of the uniform microstrip line. In this range, the phase difference is approximately constant. As the phase constant is proportional to the frequency of a signal, a constant phase shift is obtained for a large frequency bandwidth (here: 100% of center frequency). The same principle can be applied to two coupled line networks with a given length.

Figure 7:
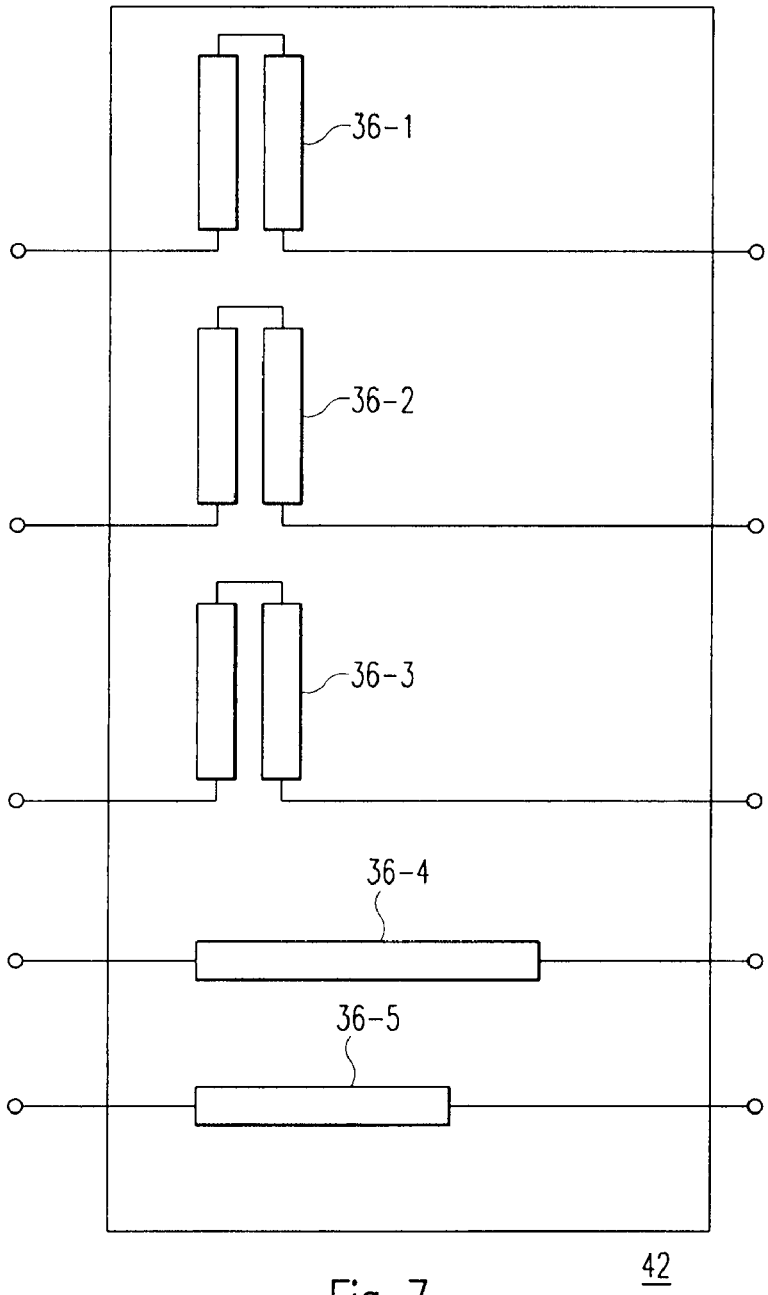
FIG. 7 shows a schematic of a phase shifter bank employed in the first embodiment.

FIG. 7 shows a schematic of the phase shifter bank 42 of the embodiment of the present invention. The phase shifter bank 42 comprises three coupled microstrip lines 36-1, 36-2, 36-3 and two uniform microstrip lines 36-4, 36-5, which, together, form the five delay lines 36. The first coupled line 36-1 and the first microstrip line 36-4 are used to generate the 225° relative phase shift, the second coupled line 36-2 and the second microstrip line 36-5 are used to generate the 135° relative phase shift and the third coupled line 36-3 and the second microstrip line 36-5 are used to generate the 90° relative phase shift. Thus, the second microstrip line 36-5 serves the generation of the 90° and 135° relative phase shifts. Alternatively, separate uniform microstrip lines could be provided for the generation of the 90° and 135° phase shifts. In this alternate case, there are six delay lines 36 in total with three coupled microstrip lines and three corresponding uniform microstrip lines. However, having the microstrip line 36-5 serve a double purpose saves space and reduces the amount of paths to be switched, thus, simplifies the RF switches 44, 46. In order to apply a phase shift between any two of the radiation elements 10, the coupled line corresponding to the desired phase shift is inserted into the signal path to/from one of the two radiation elements and the uniform microstrip line corresponding to the desired phase shift is inserted into the signal path to/from the other of the two radiation elements. For example, if a 90° phase shift is to be applied between the radiation elements 10-1 and 10-4, the switches 44-1 and 46-1 insert the coupled line 36-3 into the first branch (to/from radiation element 10-1) and the switches 44-4 and 46-4 insert the microstrip line 36-5 into the fourth branch (to/from radiation element 10-4). In order to obtain the reverse shift of −90°, the switches 44-1 and 46-1 insert the microstrip line 36-5 into the first branch (to/from radiation element 10-1) and the switches 44-4 and 46-4 insert the coupled line 36-3 into the fourth branch (to/from radiation element 10-4). It can be seen, that although each phase shifter bank 42 provides the essential elements of a Schiffman phase shifters (e.g. the coupled line 36-1 and the microstrip line 36-4 may be seen as forming a 225° Schiffman phase shifter), the Schiffman phase shifters as employed in this embodiment are not located within a single phase shifter bank, but are dispersed over the phase shifter banks 42.

The described embodiment of the present invention is operable to electronically steer the beam pattern in 7 different directions by varying the phase shift characteristic applied to the signal in each branch (only the relative phase of the branch signals is relevant). For all directions, the beam width is approximately 40°. The orientation of the beam pattern is described with reference to FIGS. 8*a* to 8*g*. For this purpose the coordinate system with axes X, Y and Z defined above is described in spherical coordinates, whereby the X-Y plane forms a horizontal plane and corresponds to an angle of elevation θ=0° and the positive X-axis direction corresponds to an azimuth angle ϕ=0°.

Figure 8A:
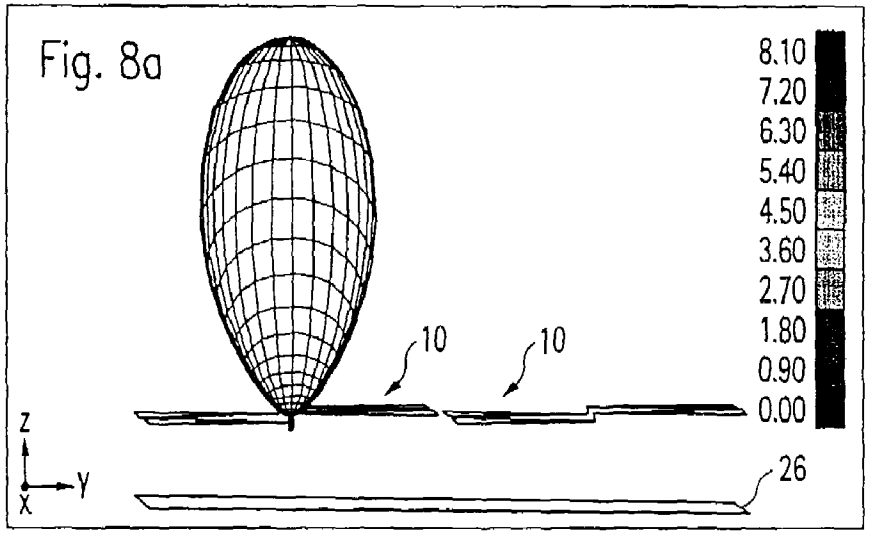
FIGS. 8*a*-8*g* show 3D surface plots of the beam pattern steered in various directions, FIG. 9 show the principle of arrangement of components of a second embodiment of the present invention, whereby like numbers refer to like elements in the drawings.

FIG. 8*a* shows the orientation of the main beam (θ=90°). The direction of maximum emission/reception of the main beam is orthogonal to the plane of the antenna array 24, orthogonal to the reflector plane 26 and points away from the reflector element 26. The main beam is obtained by selecting the same phase shifter characteristic (the same delay line 36) for all radiation elements 10.

Figure 8B:
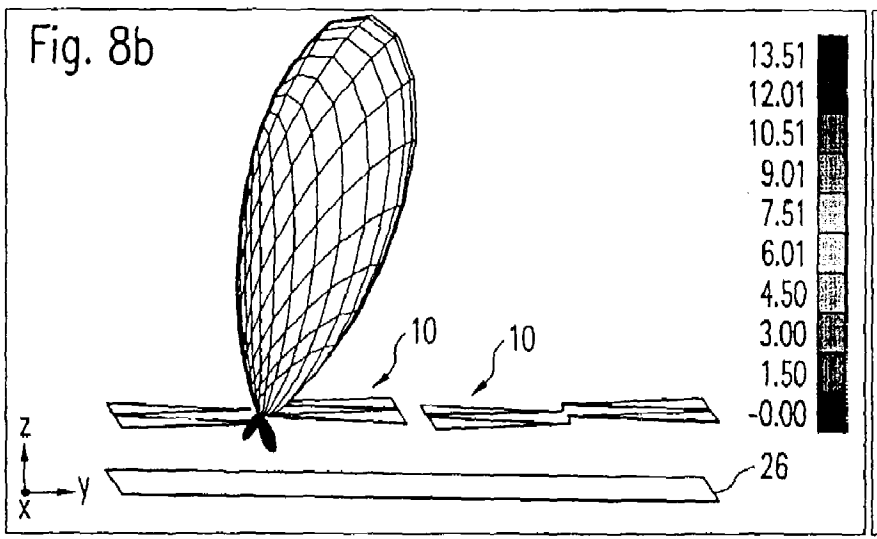
Figure 8C:
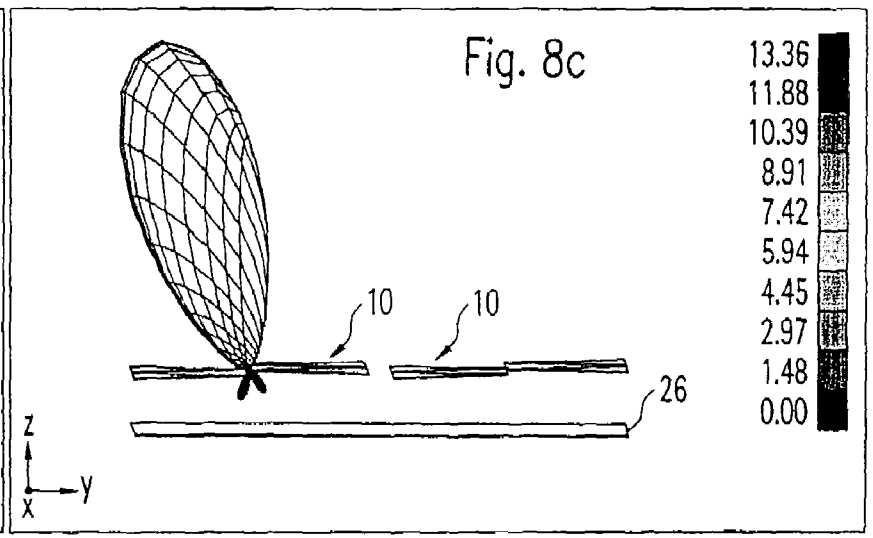

When a +/−90° phase shift is applied between radiation elements 10-1 and 10-2 and between the radiation elements 10-4 and 10-3, the beam pattern is tilted by approximately 30° from the main beam at azimuth angles of 0° and 180°. (θ=60°, ϕ=0°, 180°). This is shown in FIG. 8*b* and FIG. 8*c*.

Figure 8E:
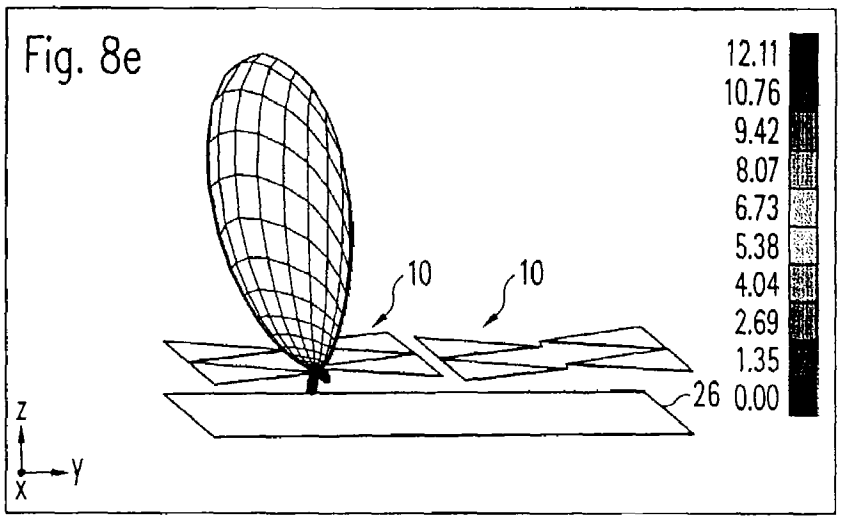
Figure 8G:
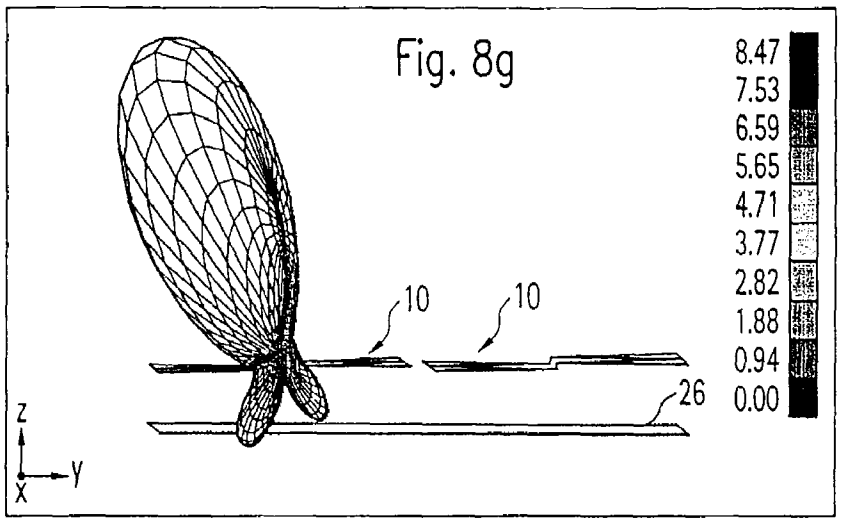
Figure 8D:
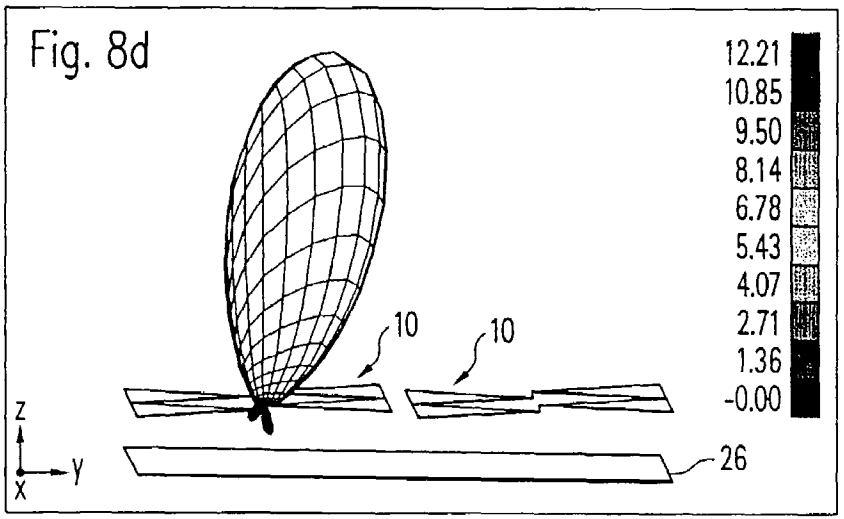
Figure 8F:
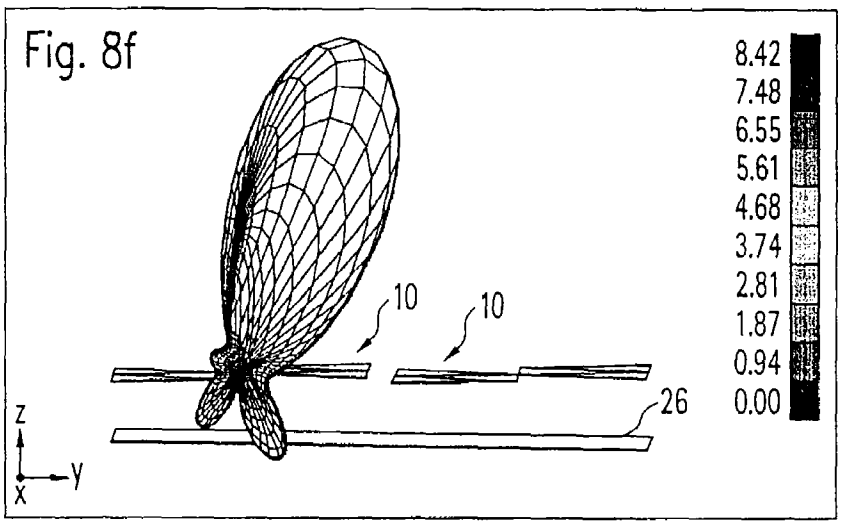

When a phase shift of +/−135° is applied between the radiation elements 10-1 and 10-2 and a phase shift of +/−90° is applied between the radiation elements 10-4 and 10-3, the beam pattern is tilted by approximately 30° from the main beam at azimuth angles of approximately 40° and 320° (θ=60°, ϕ=40°, 320°). This is shown in FIGS. 8*d* and 8*e*.

When a phase shift of +/−90° is applied between the radiation elements 10-1 and 10-2 (and a phase shift of +/−225° is applied between the radiation elements 10-4 and 10-3 the beam pattern is tilted by approximately 30° from the main beam at azimuth angles of approximately 140° and 220° (θ=60°, ϕ=140°, 220°). This is shown in FIGS. 6*f* and 6*g*.

The embodiment provides a beam steering directional radiation pattern in azimuth plane with 360° in elevation over the entire frequency range. The radiation beam thereby exhibits linear polarization and a linear phase variation Δϕversus frequency ω, thus, a constant group delay $$\tau_g(\omega) = \frac{d\varphi(\omega)}{d\omega} = \tau_{g0} \text{ with } \tau_{g0} = const. \tag{1}$$

over the entire frequency range, as well as a flat amplitude response over the entire frequency range (the antenna gain ranges from 6 to 8 dBi, i.e. the variation of the amplitude response is not more than 2 dB at the direction of maximum emission/reception). Without using a resistive loading, the return loss $$RL = -20\cdot\log_{10}|\underline{\rho}| \text{ [dB]}, \tag{2a}$$

which is defined over the magnitude of the complex-valued reflection coefficient $\underline{\rho}$ as the ratio (in dB) of the power incident on the antenna terminal to the power reflected from the antenna terminal, has a value of less than −10 dB in a frequency range between 3 and 5 GHz, which corresponds to a voltage standing wave ratio $$VSWR = \frac{1+|\rho|}{1-|\rho|} \quad (2b)$$

of less than 2.

The embodiment fulfills the FCC regulations and the IEEE 802.15 WPAN standards for the 3 to 5 GHz frequency range. The embodiment further provides a high antenna efficiency and allows for the control of the specific absorption rate (SAR) so that compliance with the FCC standards on mobile headset emission is easily achieved for devices equipped with it.

Figure 9:
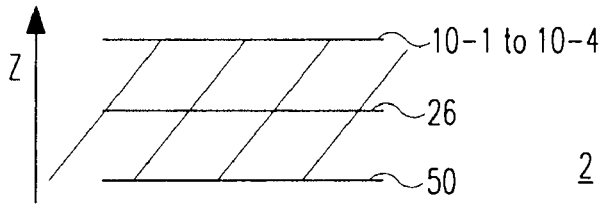

In a second embodiment, the antenna apparatus (2) is provided with a sandwiched structure as shown in FIG. 9. Here, at least part of the antenna feeding network 50 (i.e. the switches 44, 46, the phase shifter banks 42, the power splitter 38 and the interconnections) is located below the reflector element 26, thus a layered structure with the reflector element 26 in between the radiating elements 10-1, 10-2, 10-3, 10-4 and the feeding circuitry is obtained, which reduces the area needed for the antenna apparatus.

This layered structure can be integrated by filling the spaces between the network 50, the reflector plane 26 and the radiating elements 10 with electrically non-conducting material (insulator, semiconductor, . . . ). Thus the layered structure can be provided as a layered board structure.

The connection of the radiating elements 10 to the feeding circuitry may be around the reflector element 26 or by piercing the reflector element 26. Besides of this layer structure and any difference that might arise as a logical consequence of the layer structure, the second embodiment is the same as the first embodiment. Especially, the corresponding components in each branch in the second embodiment are arranged in a symmetrical manner as in the first embodiment.

The antenna apparatus of the present invention can be advantageously employed in any mobile computing or communication devices such as, for example, PCs, PDAs, peripherals, cell phones, pagers and consumer electronics for providing a wireless RF interface. However, the antenna apparatus may also be advantageously employed in non-mobile devices.

The present invention has been explained with reference to specific embodiments, this is by way of illustration only and it will be readily apparent to those skilled in the art that various modifications may be made therein without departing from the scope of the following claims.

The invention claimed is:

1. An antenna apparatus attachable to a front-end of a transceiver circuitry comprising:

at least two balanced radiation elements arranged to form a planar structure and operable to transmit a corresponding number of partial signals, the balanced radiation elements also being operable to receive the corresponding number of partial signals;

a signal splitter operable to split a signal received from an attached transceiver circuitry into said partial signals, the signal splitter being configured to combine said partial signals into a signal to be transmitted to an attached transceiver circuitry;

a phase shifter device operable to apply relative phase shifts between at least two of said partial signals, said relative phase shifts being selectable from a group of at least two relative phase shift values provided by said phase shifter device, wherein the phase shifter device includes a number of phase shifter banks according to a number of radiation elements, each phase shifter bank including a plurality of selectable delay lines, each phase shifter bank being operable to shift a phase of a corresponding one of said partial signals using a selected one of said plurality of selectable delay lines.

2. The antenna apparatus according to claim 1 wherein said signal splitter comprises a Wilkinson power splitter.

3. The antenna apparatus according to claim 1 wherein said phase shifter device is a broadband phase shifting device, operable in an ultra-wideband frequency range.

4. The antenna apparatus according to claim 1, wherein said phase shifter device comprises a Schiffmann phase shifter.

5. The antenna apparatus according to claim 1, wherein the number of balanced radiation elements is four.

6. The antenna apparatus according to claim 5 wherein the balanced radiation elements are arranged in a rectangular grid.

7. The antenna apparatus according to claim 5 wherein said phase shifter device is operable to apply six different nonzero phase shift values between any two of said partial signals, and every one of the six different phase shift values having another one of six different phase shift values with a same absolute value but opposite sign.

8. The antenna apparatus according to claim 5 wherein the phase shifter banks (42) are identical.

9. The antenna apparatus according to claim 8 wherein each of said phase shifter banks comprises exactly five selectable delay lines.

10. The antenna apparatus according to claim wherein at least one of the radiation elements comprises at least one balance element having a signal feeding point of variable width with respect to a distance from the signal feeding point.

11. The antenna apparatus according to claim 1 wherein the balanced radiation elements are identical.

12. The antenna apparatus according to claim 1 wherein the signal path of two partial signals between which no relative phase shift is applied is mirror symmetric or point symmetric.

13. The antenna apparatus according to claim 1 wherein the balanced radiation elements are operable to emit a radiation beam which has a linear polarization, the balanced radiation elements also being operable to receive the radiation beam.

14. The antenna apparatus according to claim 1 wherein a radiation beam emitted from or received by the balanced radiation elements has an amplitude response variation of the amplitude response of equal or less than 2 dBi over an ultra-wideband frequency range.

15. The antenna apparatus according to claim 1 wherein a radiation beam emitted from and/or received by the balanced radiation elements has a linear phase variation with respect to frequency over an ultra-wideband frequency range.

16. The antenna apparatus according to claim 1 wherein the antenna has a return of loss less than −10 dB in an ultra-wideband frequency range.

17. The antenna apparatus according to claim 1 further comprising a planar reflector element parallel to the balanced radiation elements.

18. The antenna apparatus according to claim 17, wherein the reflector element is located between the radiation elements and the phase shifter device, the reflector element also being located between the balanced radiation elements and the signal splitter.

19. The antenna apparatus according to claim 1, wherein the radiation elements have a shape of parallelograms or bow-ties.

20. An RF transceiver comprising:

transceiver front-end circuitry; and an antenna apparatus including:

at least two balanced radiation elements arranged to form a planar structure, and configured to transmit and/or receive a corresponding number of partial signals;

a signal splitter configured to split a signal received from an attached transceiver circuitry into said partial signals, the signal splitter combining said partial signals into a signal to be transmitted to an attached transceiver circuitry;

a phase shifter device configured to apply relative phase shifts between at least two of said partial signals, said relative phase shifts being selectable from a group of at least two relative phase shift values provided by said phase shifter device, wherein the phase shifter device includes a number of phase shifter banks according to a number of radiation elements, each phase shifter bank including a plurality of selectable delay lines, each phase shifter bank being configured to shift a phase of a corresponding one of said partial signals using a selected one of said plurality of selectable delay lines, wherein the transceiver front-end circuitry and the antenna apparatus are provided on a single printed circuit board.

21. The RF transceiver according to claim 20, wherein the antenna apparatus and the transceiver front-end circuitry share the core substrate of conducting material of the printed circuit board.

22. A mobile device comprising:

a transceiver front-end circuitry; and an antenna apparatus including:

at least two balanced radiation elements arranged to form a planar structure and configured to transmit a corresponding number of partial signals, the balanced radiation elements also being configured to receive the corresponding number of partial signals;

a signal splitter configured to split a signal received from an attached transceiver circuitry into said partial signals, the signal splitter being configured to combine said partial signals into a signal to be transmitted to an attached transceiver circuitry;

a phase shifter device configured to apply relative phase shifts between at least two of said partial signals, said relative phase shifts are selectable from a group of at least two relative phase shift values provided by said phase shifter device, wherein the phase shifter device includes a number of phase shifter banks according to a number of radiation elements, each phase shifter bank including a plurality of selectable delay lines, each phase shifter bank being configured to shift a phase of a corresponding one of said partial signals using a selected one of said plurality of selectable delay lines.

* * * * *